US008628381B2

(12) United States Patent
Arvinte et al.

(10) Patent No.: US 8,628,381 B2
(45) Date of Patent: Jan. 14, 2014

(54) DRYWALL SPONGE SANDER

(75) Inventors: Roméo Arvinte, Laval-des-Rapides (CA); François Panfili, Berthierville (CA)

(73) Assignee: A. Richard Tools Co., Berthierville, Quebec (CA)

( * ) Notice: Subject to any disclaimer, the term of this patent is extended or adjusted under 35 U.S.C. 154(b) by 389 days.

(21) Appl. No.: 12/987,848

(22) Filed: Jan. 10, 2011

(65) Prior Publication Data

US 2011/0171889 A1 Jul. 14, 2011

Related U.S. Application Data

(60) Provisional application No. 61/293,386, filed on Jan. 8, 2010.

(51) Int. Cl.
*B24D 3/00* (2006.01)

(52) U.S. Cl.
USPC ..... 451/354; 451/523; 451/525

(58) Field of Classification Search
USPC ..... 451/523, 525, 354
See application file for complete search history.

(56) References Cited

U.S. PATENT DOCUMENTS

| | | | | |
|---|---|---|---|---|
| 3,822,518 | A | 7/1974 | Sjostrand | |
| 4,885,876 | A | 12/1989 | Henke | |
| D311,318 | S | 10/1990 | Ovens | |
| 6,468,141 | B1 | 10/2002 | Conboy et al. | |
| 6,860,799 | B2 * | 3/2005 | Loveless | 451/354 |
| 7,011,573 | B2 * | 3/2006 | McArthur et al. | 451/523 |
| 7,014,550 | B2 * | 3/2006 | Mansfield et al. | 451/512 |
| 7,396,276 | B2 | 7/2008 | Ali et al. | |
| 7,416,477 | B2 | 8/2008 | Henke et al. | |
| 7,488,242 | B2 | 2/2009 | Gringer et al. | |
| 7,632,174 | B2 | 12/2009 | Gringer et al. | |
| 7,815,494 | B2 | 10/2010 | Gringer et al. | |
| 2004/0038633 | A1 * | 2/2004 | Mansfield et al. | 451/514 |
| 2004/0180616 | A1 * | 9/2004 | Loveless | 451/354 |
| 2005/0287937 | A1 | 12/2005 | Florio | |
| 2010/0009609 | A1 | 1/2010 | Dow et al. | |
| 2010/0048111 | A1 | 2/2010 | Gringer et al. | |

* cited by examiner

*Primary Examiner* — Maurina Rachuba
(74) *Attorney, Agent, or Firm* — Merchant & Gould P.C.

(57) ABSTRACT

A sanding device for use with an abrasive sponge includes a base, at least one retaining mechanism, and at least one engaging mechanism. The base has opposite supporting and working surfaces, the working surface being shaped and sized for receiving the abrasive sponge. Each retaining mechanism is mountable onto the base, and is configured for removably securing a first portion of the abrasive sponge against the working surface of the base. Each engaging mechanism is mountable onto the base, and is configured for projecting out from the working surface so as to penetrate a second portion of the abrasive sponge when resting against the working surface of the base, each engaging mechanism being further configured so as to draw the second portion of the abrasive sponge away from the first portion. Each engaging mechanism is operable between a first configuration, where it is disengaged from the abrasive sponge thereby allowing the abrasive sponge to be removed from the working surface of the base, and a second configuration, where it is penetrated within the second portion of the abrasive sponge and has drawn the second portion away from the first portion so as to securely maintain the abrasive sponge against the working surface of the base.

23 Claims, 10 Drawing Sheets

DRYWALL SPONGE SANDER

This application claims benefit of Ser. No. 61/293,386, filed 8 Jan. 2010 in the United States and which application is incorporated herein by reference. To the extent appropriate, a claim of priority is made to each of the above disclosed applications.

FIELD OF THE INVENTION

The present invention relates to a sanding device. More particularly, in its intended preferred use, the present invention relates to an improved sanding device (also referred to herein as a "drywall sponge sander"), to be used with an abrasive sponge for example, for sanding applications and the like, as well as to a kit for assembling the same, and corresponding methods of assembling and use associated thereto.

BACKGROUND OF THE INVENTION

Known in the art are various devices used for sanding applications and the like. For example, known to the Applicant are the following US patents, patent applications and industrial design: U.S. Pat. Nos. 3,822,518; 4,885,876; 6,468,141 B1; 7,396,276 B2; 7,416,477 B2; 7,488,242 B2; 7,632,174 B2; 7,815,494 B2; 2005/0287937 A1; 2010/0009609 A1; 2010/0048111 A1; and Des. 311,318.

Also known to the Applicant is U.S. Pat. No. 7,011,573 B2 granted to McARTHUR et al. on Mar. 14, 2006, which relates to a drywall sanding apparatus. The drywall sanding apparatus provides a tool assembly for finishing drywall preparation for paint or wallpaper. The apparatus comprises an attachment device for attachment of an abrasive sponge and at least one fastening member for holding the abrasive sponge to the attached device. The fastening member includes an insertion portion for penetration into an abrasive sponge to hold the attachment device adjacent the sponge during operation of the sanding device.

Also known the art are the substantial drawbacks associated with such conventional sanding devices, for example: a) the need to screw-in a pair of fastening members with helically-shaped penetrating portions into the abrasive sponge order to secure the sponge onto the base, which is a long and tedious process; b) the pair of fastening members with helically-shaped penetrating portions are disposed adjacent to the center of the base which does not enable for a uniform and spread-out securing of the abrasive sponge through the entire length thereof; c) the fastening members with helically-shaped penetrating portions can be unscrewed and completely removed from the tool thereby resulting in a possible loss or other associated inconveniences; d) interference of the swivel assembly with surface components of the base for a staggered rotation of the swivel component when operated or rotated near the base; e) it is not possible to tighten the abrasive sponge against the base via the fastening members given that they are meant to penetrate "linearly" or "vertically" into the abrasive sponge via a rotation of their helically-shaped penetrating portions; f) etc.

Hence, in light of the aforementioned, there is a need for an improved device which, by virtue of its design and components, would be able to overcome or at least minimize some of the aforementioned prior art problems.

SUMMARY OF THE INVENTION

An object of the present invention is to provide a device, which by virtue of its design and components, satisfies some of the above-mentioned needs and is thus an improvement over other related devices and/or methods known in the prior art.

In accordance with the present invention, the above object is achieved, as will be easily understood, with an engaging mechanism for a sanding device (and resulting "sanding device", "tool" and/or "aggregate tool"), such as the one briefly described herein, and such as the one exemplified in the accompanying drawings.

Preferably, the resulting tool is a sander, such as a drywall sponge sander, for example. The sanding device may be used with a complementary tool, such as an extension pole or any other suitable component (ex. handle, support, etc.), for providing a resulting aggregate tool.

According to an aspect of the present invention, there is provided a sanding device for use with an abrasive sponge, the sanding device comprising:

a base having opposite supporting and working surfaces, the working surface being shaped and sized for receiving the abrasive sponge thereagainst;

at least one retaining mechanism mountable onto the base, and configured for removably securing a first portion of the abrasive sponge against the working surface of the base; and at least one engaging mechanism mountable onto the base, and configured for projecting out from the working surface so as to penetrate a second portion of the abrasive sponge when resting against the working surface of the base, each engaging mechanism being further configured so as to draw the second portion of the abrasive sponge away from the first portion thereof, each engaging mechanism being operable between a first configuration where it is disengaged from the abrasive sponge thereby allowing the abrasive sponge to be removed from the working surface of the base, and a second configuration where it is penetrated into the second portion of the abrasive sponge and has drawn said second portion away from the first portion so as to securely maintain the abrasive sponge against the working surface of the base.

As can be easily understood by a person skilled in the art when referring to the following description, each retaining mechanism may be a mechanism separate and different from the engaging mechanism, but according to a preferred embodiment of the present invention, the retaining mechanism is an engaging mechanism, and thus, the sanding device preferably comprises a pair of engaging mechanisms, as exemplified in the accompanying drawings.

Preferably also, each engaging mechanism comprises at least one hook being operable by a user of the sanding device between the first and second configurations, each hook being positioned, shaped and sized for selectively engaging with the abrasive sponge within said abrasive sponge.

Preferably also, each hook is substantially arched-shaped, and each hook is configured to be engageable into the abrasive sponge in a direction extending substantially away from the center of the base for tightening the abrasive sponge against the working surface of the base when the sanding device is operated in the second configuration.

Preferably also, each engaging mechanism is rotatably mountable onto the base about a corresponding pivot axis, and comprises a lever jaw, such that operation of each given engaging mechanism between the first and second configurations is done by rotating the given engaging mechanism about its corresponding pivot avis via its given lever jaw.

Preferably also, each hook is insertable into the abrasive sponge through a corresponding through-hole provided along the base, and according to a preferred embodiment of the present invention, the base is substantially rectangular, and a corresponding through-hole is provided substantially about each corner of the base.

Preferably, each engaging mechanism is rotatably mountable onto the base about a corresponding pivot axis, and comprises a lever jaw, such that operation of each given engaging mechanism between the first and second configurations is done by rotating the given engaging mechanism about its corresponding pivot axis via its given lever jaw.

Preferably also, each engaging mechanism is rotatably mountable about its corresponding pivot axis by means of a least one hinge.

Preferably, the supporting surface of the base comprises at least one arched supporting rim disposed about the center of the base, and configured for supporting a swivel assembly of the sanding device when said swivel assembly is rotated at a near angle with respect to the base so that the swivel component may slide against said at least one arched supporting rim and thus avoid interfering with surface components of the base.

According to yet another aspect of the present invention, there is also provided a method of operating the above-mentioned engaging mechanism, sanding device and/or resulting tool.

According to yet another aspect of the present invention, there is also provided a kit with components for assembling the above-mentioned engaging mechanism, sanding device and/or resulting tool.

According to yet another aspect of the present invention, there is also provided a set of components for interchanging with components of the above-mentioned engaging mechanism, sanding device and/or resulting tool.

According to yet another aspect of the present invention, there is also provided a method of assembling components of the above-mentioned kit and/or set.

According to another aspect of the present invention, there is also provided a method of manufacturing the above-mentioned engaging mechanism, sanding device, resulting tool and/or components thereof.

According to another aspect of the present invention, there is also provided a surface having been treated with the above-mentioned sanding device and/or resulting tool.

According to another aspect of the present invention, there is also provided an object provided with at least one surface having been treated with the above-mentioned sanding device and/or resulting tool. For example, the object could be a building and the at least one surface can be a plurality of wall surfaces.

The objects, advantages and other features of the present invention will become more apparent upon reading of the following non-restrictive description of preferred embodiments thereof, given for the purpose of exemplification only, with reference to the accompanying drawings.

DETAILED DESCRIPTION OF PREFERRED EMBODIMENTS OF THE INVENTION

Figure 1:
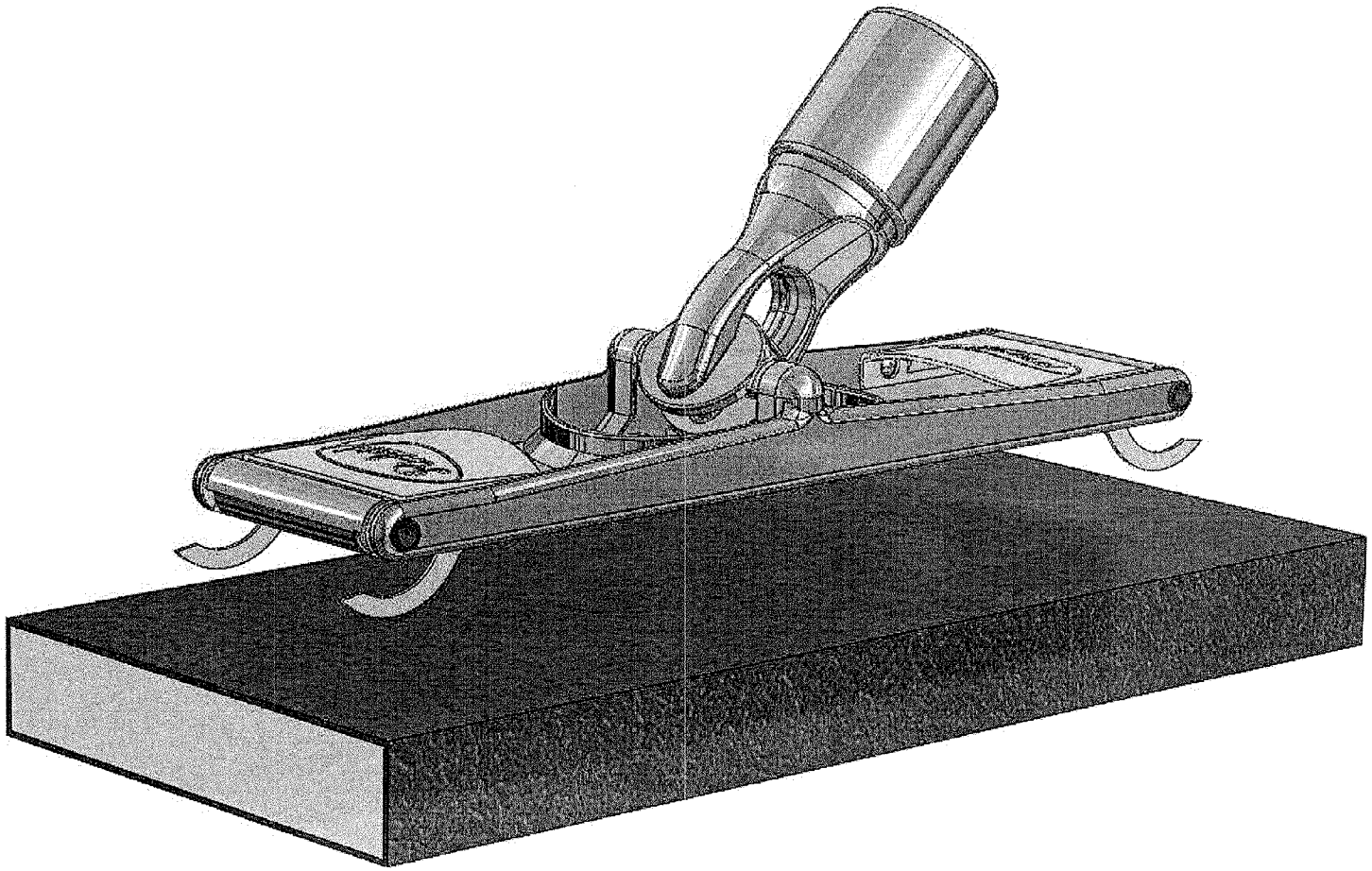
FIG. 1 is a top perspective view of a drywall sponge sander shown placed above a drywall sponge, and being shown operated along a given configuration, according to a first preferred embodiment of the present invention.

In the following description, the same numerical references refer to similar elements. Furthermore, for sake of simplicity and clarity, namely so as to not unduly burden the figures with several reference numbers, only FIG. 9 has been provided with all of the reference numbers of the present description, and components and features of the present invention illustrated in other figures can be easily inferred therefrom and/or, in some cases, have been selectively identified with reference numbers. The embodiments, geometrical configurations, materials mentioned and/or dimensions shown in the figures are preferred, for exemplification purposes only.

Moreover, although the present invention was primarily designed for sanding applications, as well as carrying out other possible functions related thereto (e.g. polishing, surfacing, etc.), it may be used with other types of materials and objects and in other fields, as apparent to a person skilled in the art. For this reason, expressions such as "drywall", "sponge", "sander", "tool", etc., as used herein should not be taken as to limit the scope of the present invention and includes all other kinds of materials, objects and/or purposes with which the present invention could be used and may be useful.

Moreover, in the context of the present invention, the expressions "sander", "tool", "device", "handle", "unit", "product", "apparatus", "assembly" and any other equivalent expression known in the art will be used interchangeably. Furthermore, the same applies for any other mutually equivalent expressions, such as "drywall", "wall" and "surface", as well as "tool" and "base" for example, as also apparent to a person skilled in the art. The same can be said for "engaging", "hooking", "stretching", "penetrating", "shearing" and "inserting" for example, as well as "sanding", "abrasive" and "surfacing", or even "operating", "using", "retracting", "pivotating" and "rotating", as also apparent to a person skilled in the art.

In addition, although the preferred embodiment of the present invention as illustrated in the accompanying drawings comprises various components and although the preferred embodiment of the engaging mechanism (11) and resulting sanding device (1) or aggregate tool (e.g. sander with extension pole) as shown consists of certain geometrical configurations as explained and illustrated herein, not all of these components and geometries are essential to the invention and thus should not be taken in their restrictive sense, i.e. should not be taken as to limit the scope of the present invention. It is to be understood, as also apparent to a person skilled in the art, that other suitable components and cooperations thereinbetween, as well as other suitable geometrical configurations may be used for the engaging mechanism (11) and resulting sanding device (1) or tool, and corresponding parts, according to the present invention, as briefly explained and as can be easily inferred herefrom by a person skilled in the art, without departing from the scope of the invention.

LIST OF NUMERICAL REFERENCES FOR SOME OF THE CORRESPONDING PREFERRED COMPONENTS ILLUSTRATED IN THE ACCOMPANYING DRAWINGS

1. sanding device (or "drywall sponge sander")
3. base
5. supporting surface (of base 3)
7. working surface (of base 3)
9. abrasive sponge
11. engaging mechanism
11*a*. first engaging mechanism
11*b*. second engaging mechanism
13. hook (of engaging mechanism 11)
15. through-hole (of base 3)
17. center (of base 3)
19. pivot axis
21. lever jaw
23. hinge
25. dowel pin
27. sleeve
29. clip mechanism
31. insert
33. slot
35. side portion (of lever jaw 21)
37. flange (of base 3)
39. swivel assembly
41. connector
43. support rod
45. support (or "shoulder")
45*a*. first support (or "shoulder")
45*b*. second support (or "shoulder")
47. swivel component
49. socket component
49*a*. first socket component
49*b*. second socket component
49*c*. socket
51. mounting recess
53. extension arm
55. male part
57. female part
59. orifice (of swivel component 47)
61. collar
63. supporting rim
63*a*. first supporting rim
63*b*. second supporting rim Broadly described, the sanding device (1) according to the present invention, as shown in the accompanying drawings, is a device (1) which, in its preferred intended use, is an improved sanding device (1), onto which is conveniently mounted an abrasive sponge (9) (or any other suitable sanding or surfacing component), so as to form a resulting tool, which may be provided with a complementary tool, such an extension pool and/or the like.

As illustrated in the accompanying figures, the sanding device (1) comprises a base (3), at least one retaining mechanism and at least one engaging mechanism (11). The base (3) preferably has opposite supporting and working surfaces (5,7), the working surface (7) being shaped and sized for receiving the abrasive sponge (9) thereagainst. Each retaining mechanism is preferably mountable onto the base (3), and configured for removably securing a first portion of the abrasive sponge (9) against the working surface (7) of the base (3). As can be easily understood when referring to FIGS. 1-5, each engaging mechanism (11) is mountable (or "mounted" once the sanding device (1) is assembled) onto the base (3), and configured for projecting out from the working surface (7) so as to penetrate a second portion of the abrasive sponge (9) when resting against the working surface (7) of the base (3), each engaging mechanism (11) being further configured so as to draw the second portion of the abrasive sponge (9) away from the first portion thereof, each engaging mechanism (11) being operable between a first configuration (see FIG. 3, for example) where it is disengaged from the abrasive sponge (9) thereby allowing the abrasive sponge (9) to be removed from the working surface (7) of the base (3), and a second configuration (see FIGS. 4 and 5, for example) where it is penetrated into the second portion of the abrasive sponge (9) and has drawn said second portion away from the first portion so as to securely maintain the abrasive sponge (9) against the working surface (7) of the base (3).

As explained earlier, each retaining mechanism may be a mechanism separate and different from the engaging mechanism (11), such as the various ones known in the prior art, but according to a preferred embodiment of the present invention, the retaining mechanism is an engaging mechanism (11), and thus, the sanding device (1) preferably comprises a pair of engaging mechanisms (11), as exemplified in the accompanying drawings.

Figure 3:
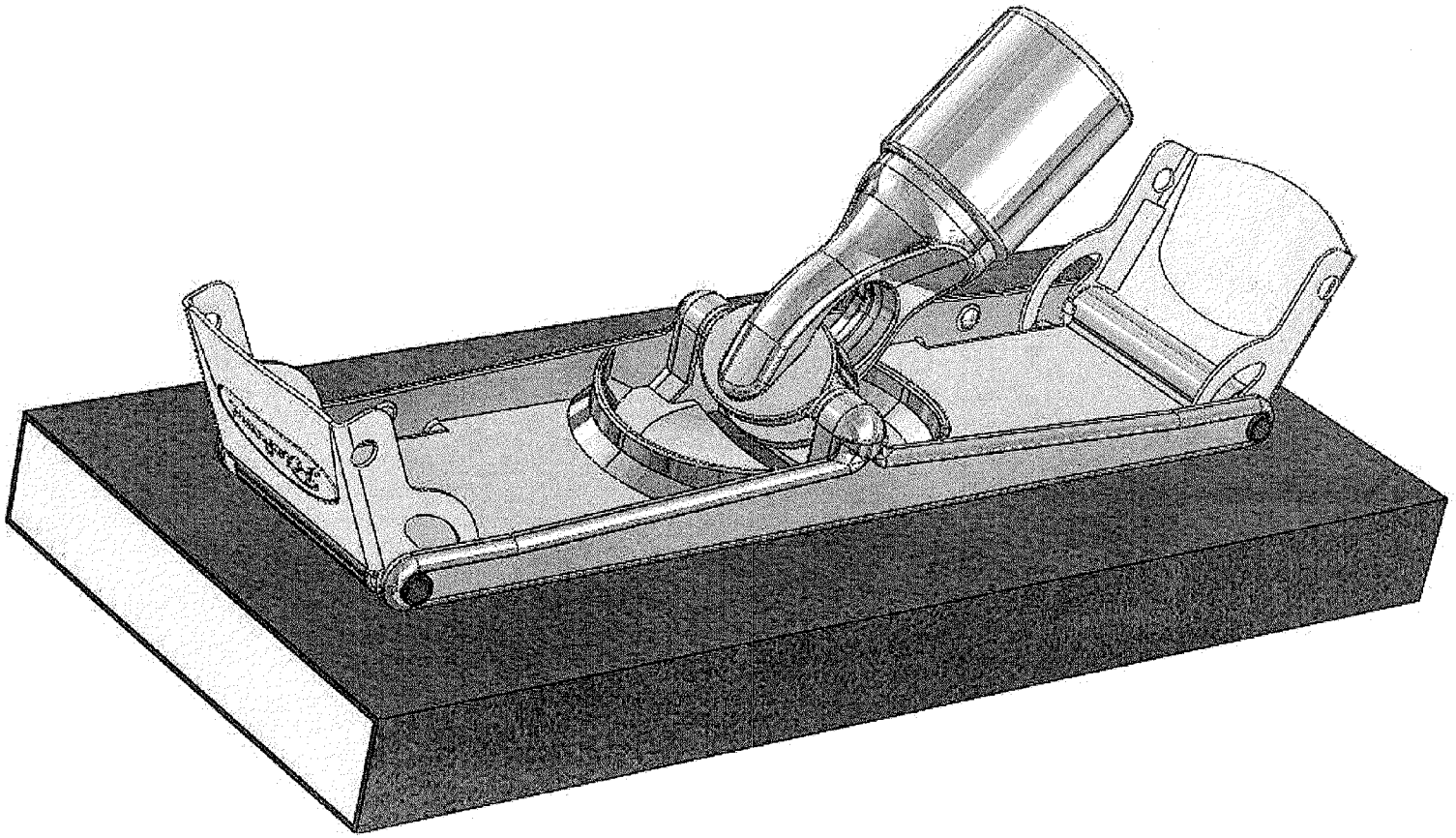
FIG. 3 is another top perspective view of the drywall sponge sander of FIG. 1, the drywall sponge sander being now shown placed against the drywall sponge, and operated along another configuration, according to a preferred embodiment of the present invention.
Figure 4:
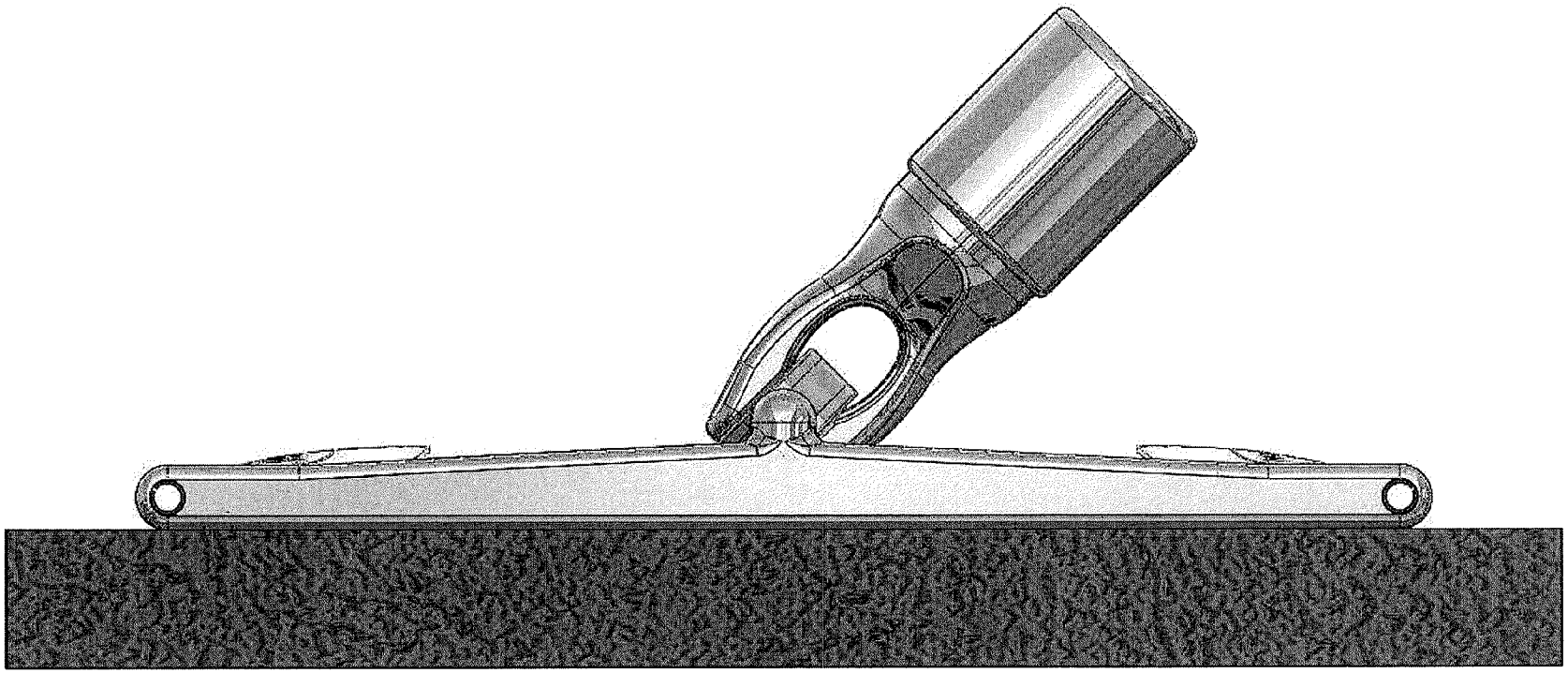
FIG. 4 is a side elevational view of what is shown in FIG. 3, the drywall sponge sander being now shown operated along yet another working configuration where components of the drywall sponge sander are engaged into the drywall sponge.
Figure 5:
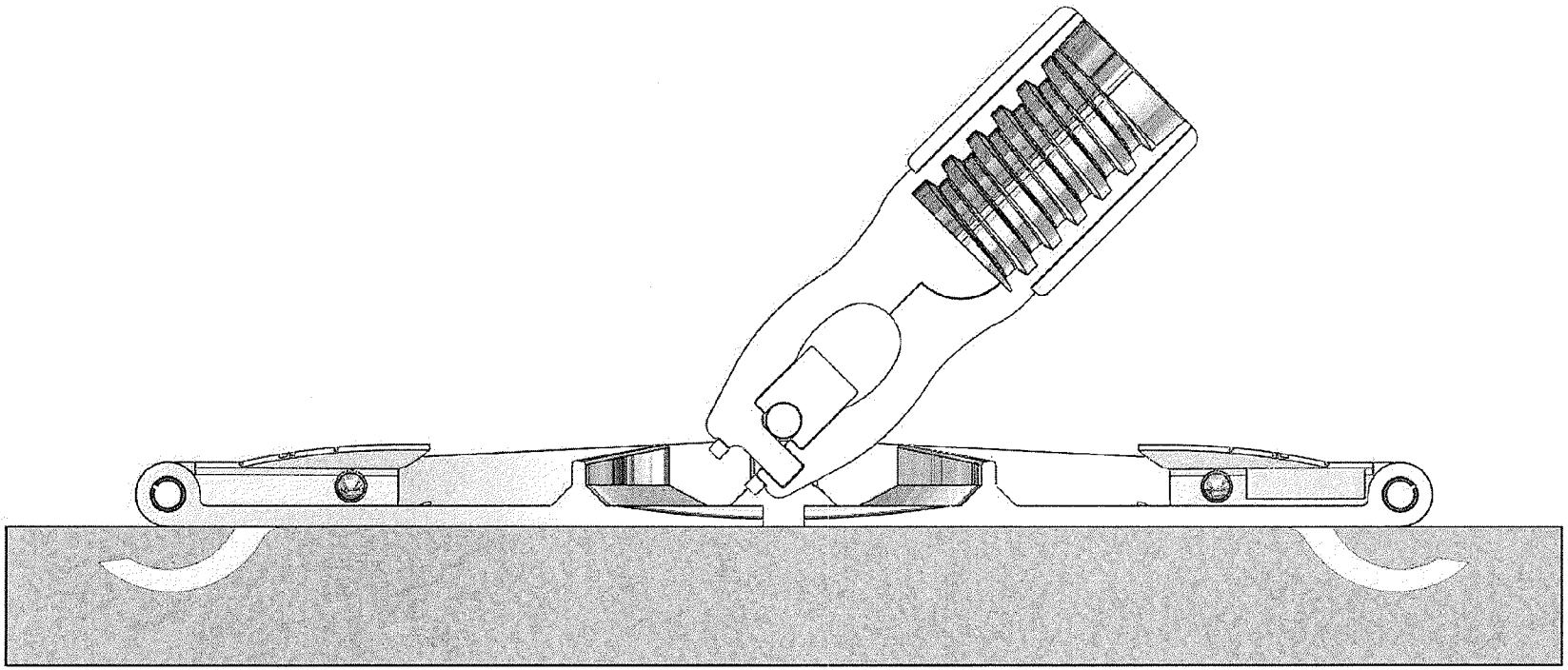
FIG. 5 is a cut-a-away view of what is shown in FIG. 4 to better illustrate the components of the drywall sponge sander being engaged into the drywall sponge.
Figure 6:
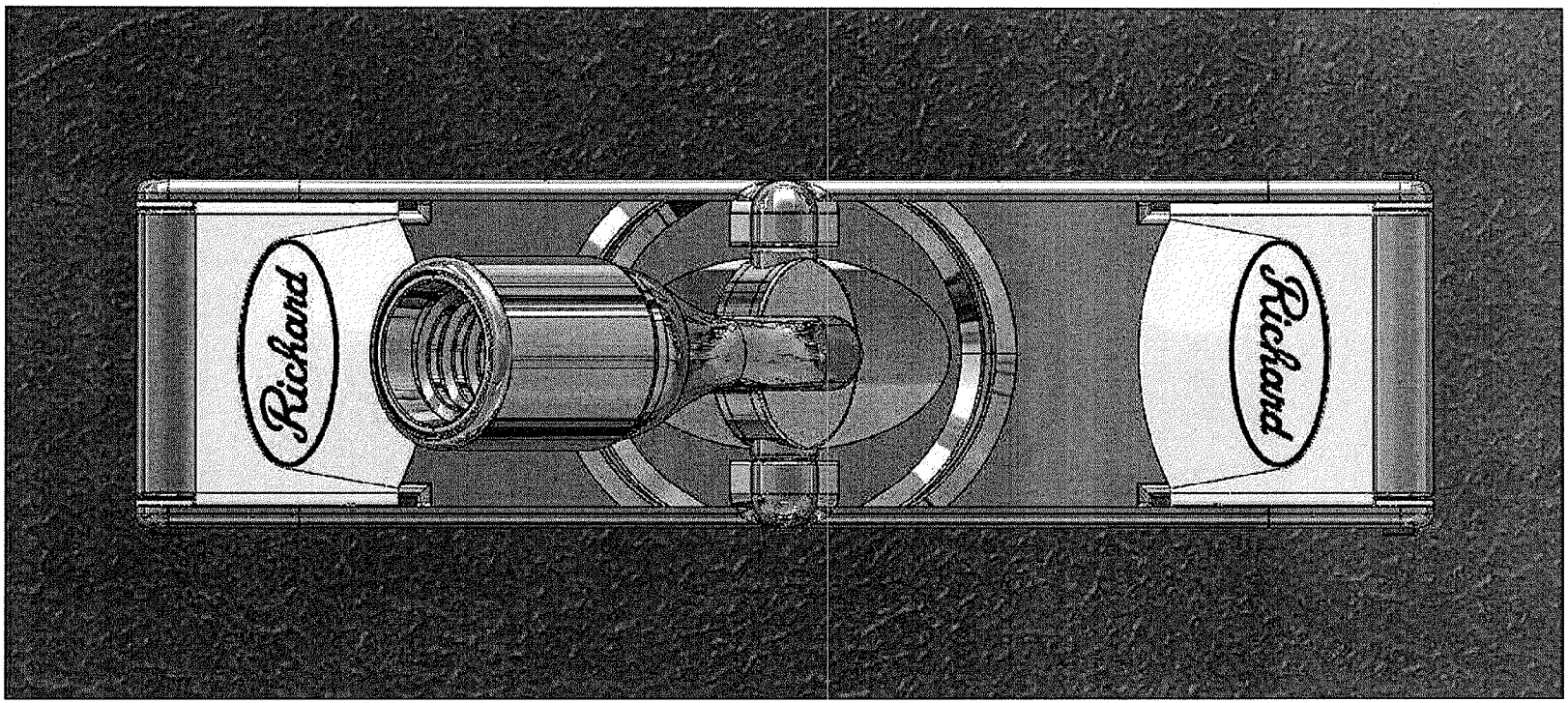
FIG. 6 is a top plan view of what is shown in FIG. 4.

Preferably also, and as better shown in FIGS. 1-10, each engaging mechanism (11) comprises at least one hook (13) being operable by a user of the sanding device (1) between the first and second configurations, each hook (13) being positioned, shaped and sized for selectively engaging with the abrasive sponge (9) within said abrasive sponge (9), as better exemplified in FIG. 5.

Figure 2:
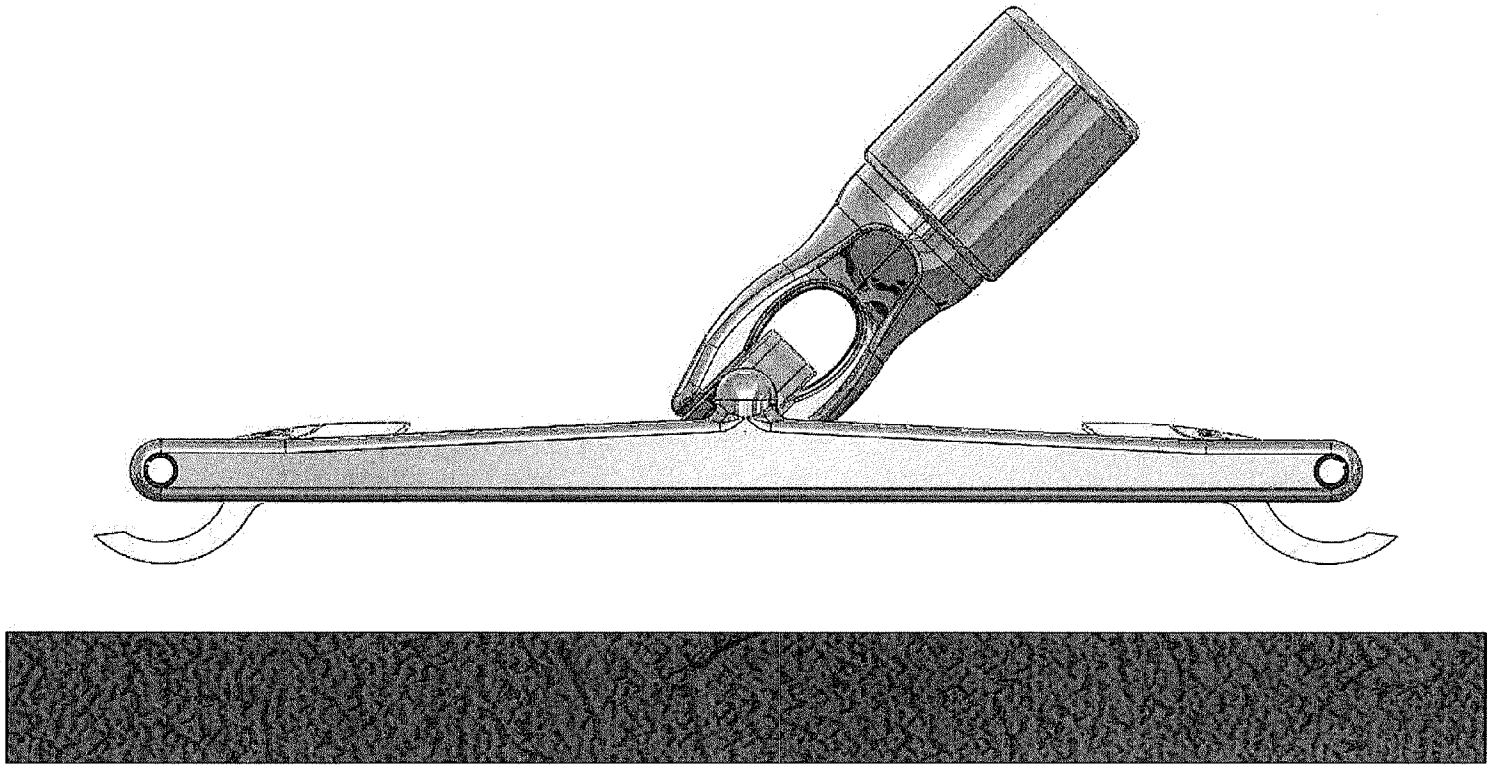
FIG. 2 is a side elevational view of what is shown in FIG. 1.
Figure 8:
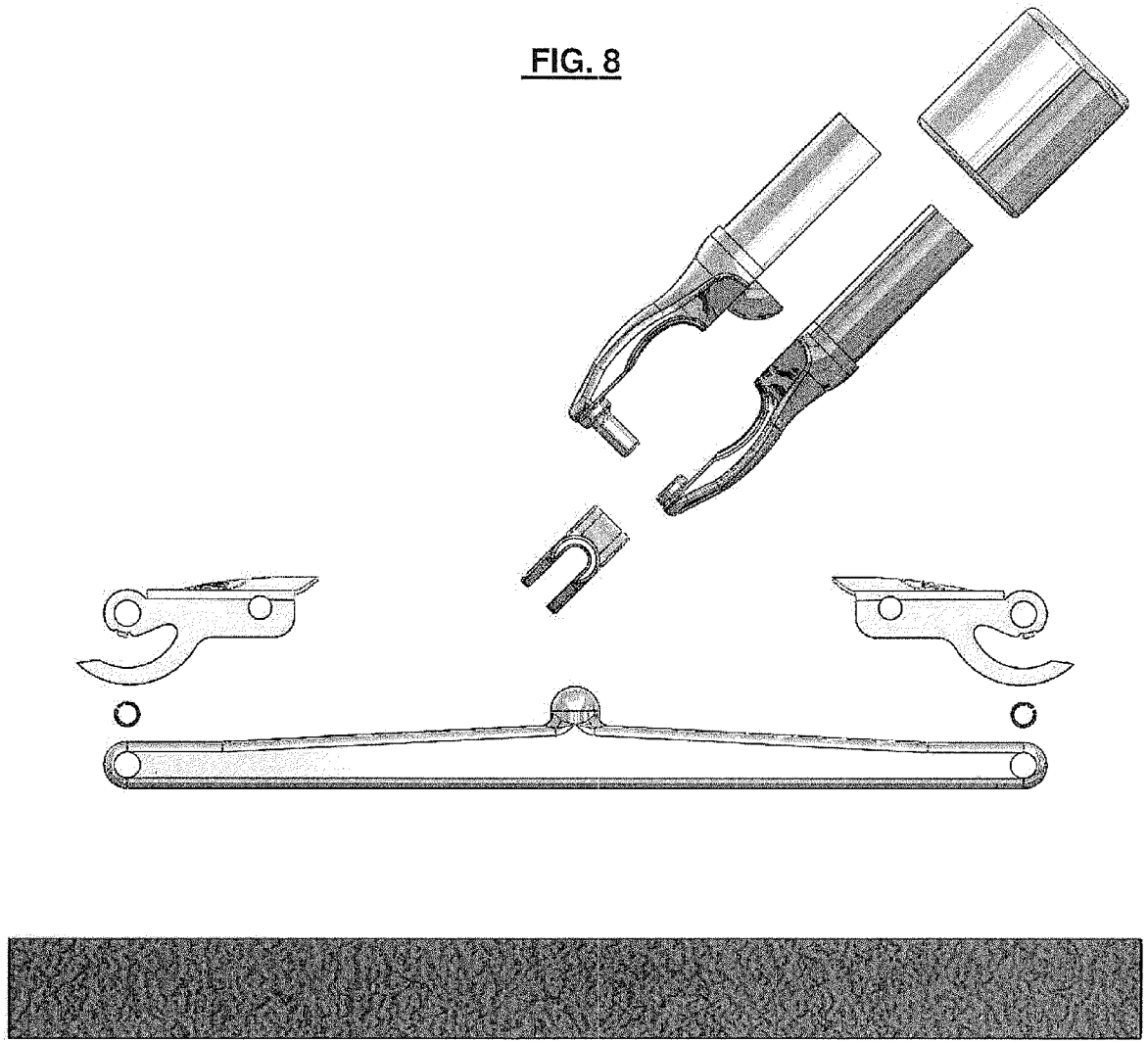
FIG. 8 is a side elevational view of what is shown in FIG. 7.

Preferably also, and as better shown in FIGS. 2 and 8, each hook (13) is substantially arched-shaped, and each hook (13) is preferably configured to be engageable into the abrasive sponge (9) in a direction extending substantially away from the center (17) of the base for tightening the abrasive sponge (9) against the working surface (7) of the base (3) when the sanding device (1) is operated in the second configuration, as can be easily understood when contrasting FIG. 3 with FIG. 5.

Figure 9:
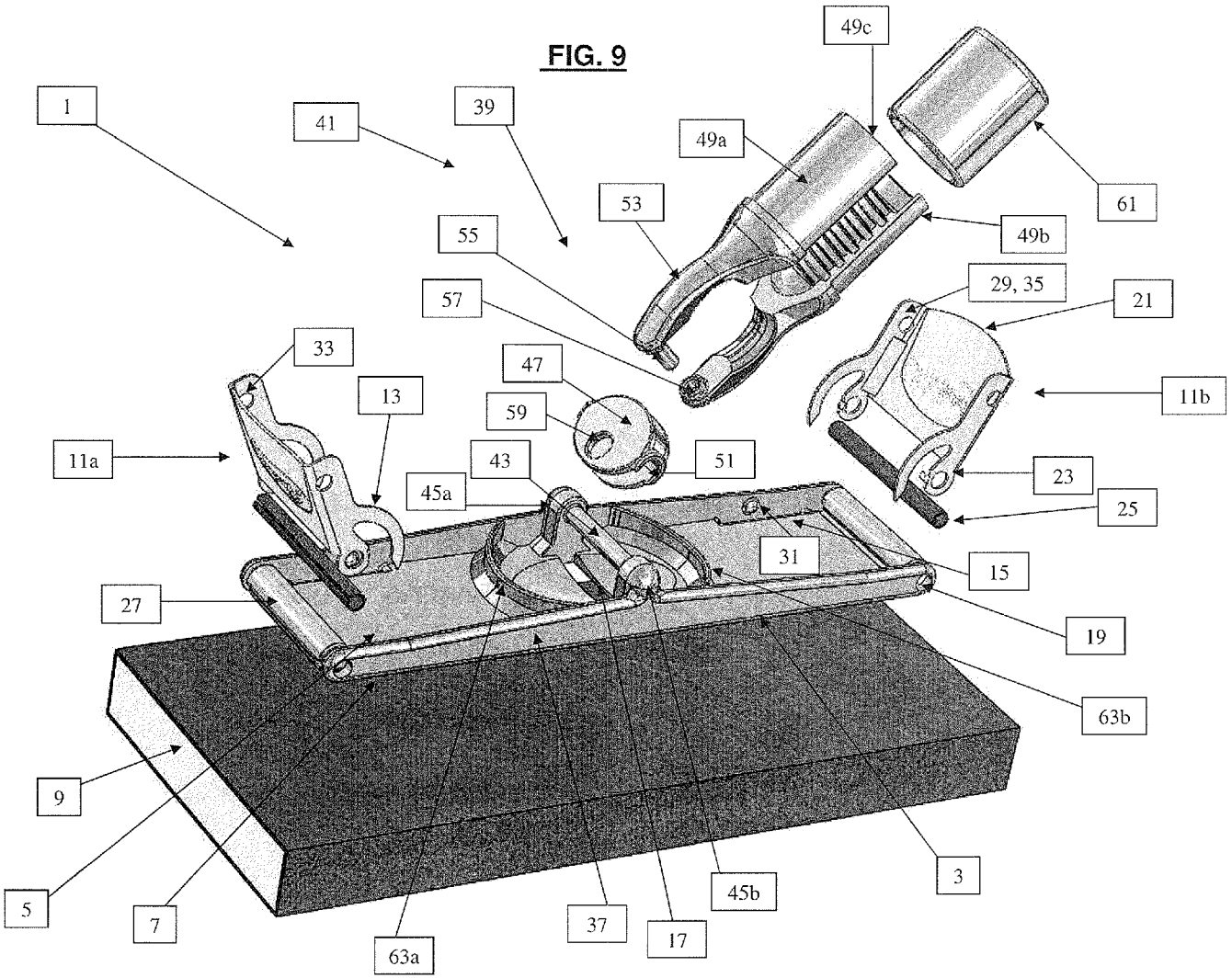
FIG. 9 is a perspective exploded view of the components of the drywall sponge sander shown in FIG. 3.

Preferably, and as better shown in FIGS. 3 and 9, each hook (13) is insertable into the abrasive sponge (9) through a corresponding through-hole (15) provided along the base (3), although hooks (13) of the engaging mechanisms (11) could ultimately be operated outside the base (3), as apparent to a person skilled in the art.

According to a preferred embodiment of the present invention, each engaging mechanism (11) is rotatably mountable onto the base (3) about a corresponding pivot axis (19), and comprises a lever jaw (21), such that operation of each given engaging mechanism (11) between the first and second configurations is done by rotating the given engaging mechanism (11) about its corresponding pivot axis (19) via its given lever jaw (21).

As can be easily understood when referring to FIGS. 7-10, each engaging mechanism (11) is preferably rotatably mountable about its corresponding pivot axis (19) by means of a least one hinge (23). According to the preferred embodiment illustrated in these figures, each engaging mechanism (11) comprises first and second hinges (23). As also shown, each pivot axis (19) is preferably provided by a corresponding dowel pin (25) removably mountable into a corresponding sleeve (27) of the base (3), each sleeve (27) of the sanding device (1) being preferably provided along a distal end of the base (3).

According a preferred embodiment of the present invention, as exemplified in the accompanying drawings, the sanding device (1) comprises first and second engaging mechanisms (11*a*,11*b*) provided respectively on opposite ends of the base (3), each engaging mechanism (11) comprising a pair of distal hooks (13), and each hook (13) of each engaging mechanism (11) being provided adjacent to a corresponding hinge (23) of the engaging mechanism (11), as better shown in FIGS. 7-10.

Preferably also, the sanding device (1) comprises at least one clip mechanism (29) associated with each engaging mechanism (11) for removably and/or selectively the engaging mechanism (11) in the second configuration, and each clip mechanism (29) preferably comprises an insert (31) and a complementary slot (33), the insert (31) being provided about a supporting component (ex. flange 37) of the base (3) and being removably insertable into the complementary slot (33) being provided about a side portion (35) or other suitable part of the engaging mechanism (11).

According a preferred embodiment of the present invention, as exemplified in the accompanying drawings, and as better shown in FIGS. 7-10, each clip mechanism (29) preferably comprises a pair of distal slots (33) each being cooperable with a corresponding insert (31) provided about an adjacent flange (37) of the base (3). It is worth mentioning however that other suitable clip mechanisms (29) may be used for selectively maintaining a given engaging mechanism (11), "locked" into position, in a second configuration, as apparent to a person skilled in the art.

Preferably also, the base (3) is substantially rectangular, and a corresponding through-hole (15) is provided substantially about each corner of the base (3), although the present invention may be used for bases (3) and/or sponges (9) having other shapes (triangular, or with more than four sides, etc.) and dispositions, as apparent to a person skilled in the art. Indeed, according to a preferred aspect of the present invention, a minimal of at least one retaining mechanism is used for retaining a first portion of the sponge (9) in place against the base (3) of the sander (1), and at least one engaging mechanism (11) such as the one described herein is further used to engage another portion of said sponge (9) and draw or "pull" it away from the first retained portion, so as to securely tighten and affix the sponge (9) against the working surface (7) of the base, as can be easily understood by a person skilled in the art. The aforementioned retaining mechanism could be an engaging mechanism (11), so as to have a pair of engaging mechanisms (11) for a same given sander (1), as exemplified in the accompanying drawings, although only one engaging mechanism (11) could ultimately be used for a sander (1) according to the present invention, as can also be easily understood by a person skilled in the art.

According to the present invention, the sanding device (1) is also preferably provided with means for allowing a user to operate it along various ranges of motion. For example, the supporting surface (5) of the base (3) may be provided with a swivel assembly (41) movable with respect to the base (3) and comprising a connector (41) for removably receiving a complementary tool. According to a preferred embodiment of the present invention, and as better shown in FIGS. 7-10, the swivel assembly (41) comprises a support rod (43) extending between first and second supports (45*a*,45*b*) of the supporting surface (5) of the base (3), a swivel component (47) rotatably mountable about the support rod (43) so as to be rotatable thereabout, and a socket component (49) rotatably mountable about the swivel component (47) so as to be rotatable thereabout.

The swivel component (47) preferably comprises a mounting recess (51) being configured for securably mounting onto the support rod (43) so as to be rotatable thereabout, and is appropriately shaped, such as a substantially oval-shape, for example, although other suitable shapes and dispositions may be used, as apparent to a person skilled in the art.

As better shown in FIGS. 7-10, the socket component (49) preferably comprises first and second components (49*a*,49*b*) being connectable against each other so as to define a socket (49*c*) for removably receiving therein an extremity of a complementary tool, and the socket (49*c*) is preferably threaded for receiving a complementary threaded extremity of a complementary tool, such an extension pole for example.

Preferably also, each component (49*a*,49*b*) of the socket component (49) is provided with an extension arm (53), an end of the extension arm (53) of the first socket component (49*a*) comprising a male part (55) being insertable into a corresponding orifice (59) of the swivel component (47) for allowing the socket component (49) to be rotated about the swivel component (47) via said male part (55) rotatable within said orifice (59), as can be easily understood when referring to FIGS. 7-10.

Preferably also, an end of the extension arm (53) of the second socket component (49*b*) is provided with a female part (57) for receiving the male part (55) of the end of the extension arm (53) of the first socket component (49*a*) when inserted into the orifice (59) of the swivel component (47).

Figure 7:
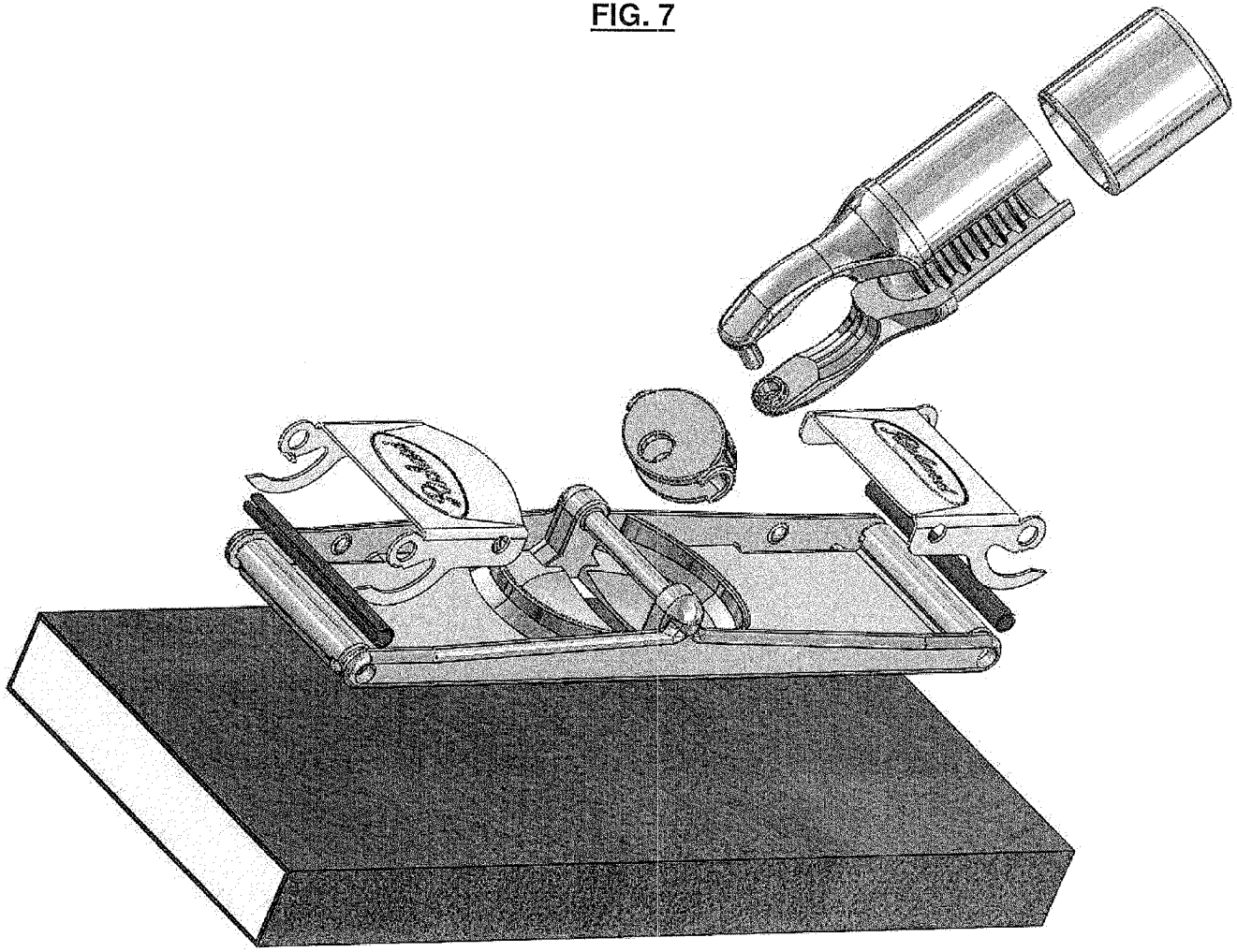
FIG. 7 is a perspective exploded view of the components of the drywall sponge sander shown in FIG. 1.

As can be easily understood when referring to FIGS. 1 and 7, the first and second components (49*a*,49*b*) of the socket component (49) are preferably securable against one another by means of a collar (61) slidably insertable about said first and second socket components (49*a*,49*b*), and preferably also, the collar (61) is force-fitted onto the first and second socket components (49*a*,49*b*) for ensuring a tight connection between said components (49). It is worth mentioning that other suitable means (ex. welding, gluing, etc.) may be used for appropriately connecting the first and second socket components (49) together, as apparent to a person skilled in the art. Furthermore, and for example, these components could be made integral to one another, that is, could be made of one single component, by a suitable manufacturing process and using appropriate materials, as also apparent to a person skilled in the art.

As better shown in FIGS. 3, 5, 6, 7 and 9, the supporting surface (5) of the base (3) preferably comprises at least one arched supporting rim (63) provided adjacent to the support rod (43), and being configured for supporting the socket component (49) when the socket component (49) is being rotated about the swivel component (47) at a near angle with respect to the base (3) so that the socket component (49) may slide against the least one arched supporting rim (63) and thus prevent interference of the socket component (49) with other surface components of the base (3), thus enabling a smooth and uninterrupted operation or rotation of the swivel assembly (39).

Preferably also, the at least one arched supporting rim (63) comprises first and second arched supporting rims (63*a*,63*b*), each being provided on either side of the support rod (43), and being positioned, shaped and sized for allowing the socket component (49) to be rotated with respect to the center (17) of the base (3) through a range of about 360 degrees without substantially interfering with other surface components of the base (3).

As better shown in FIGS. 3, 7 and 9, the base (3) comprises at least one flange (37) or rib for providing structural reinforcement to the base (3).

Figure 10:
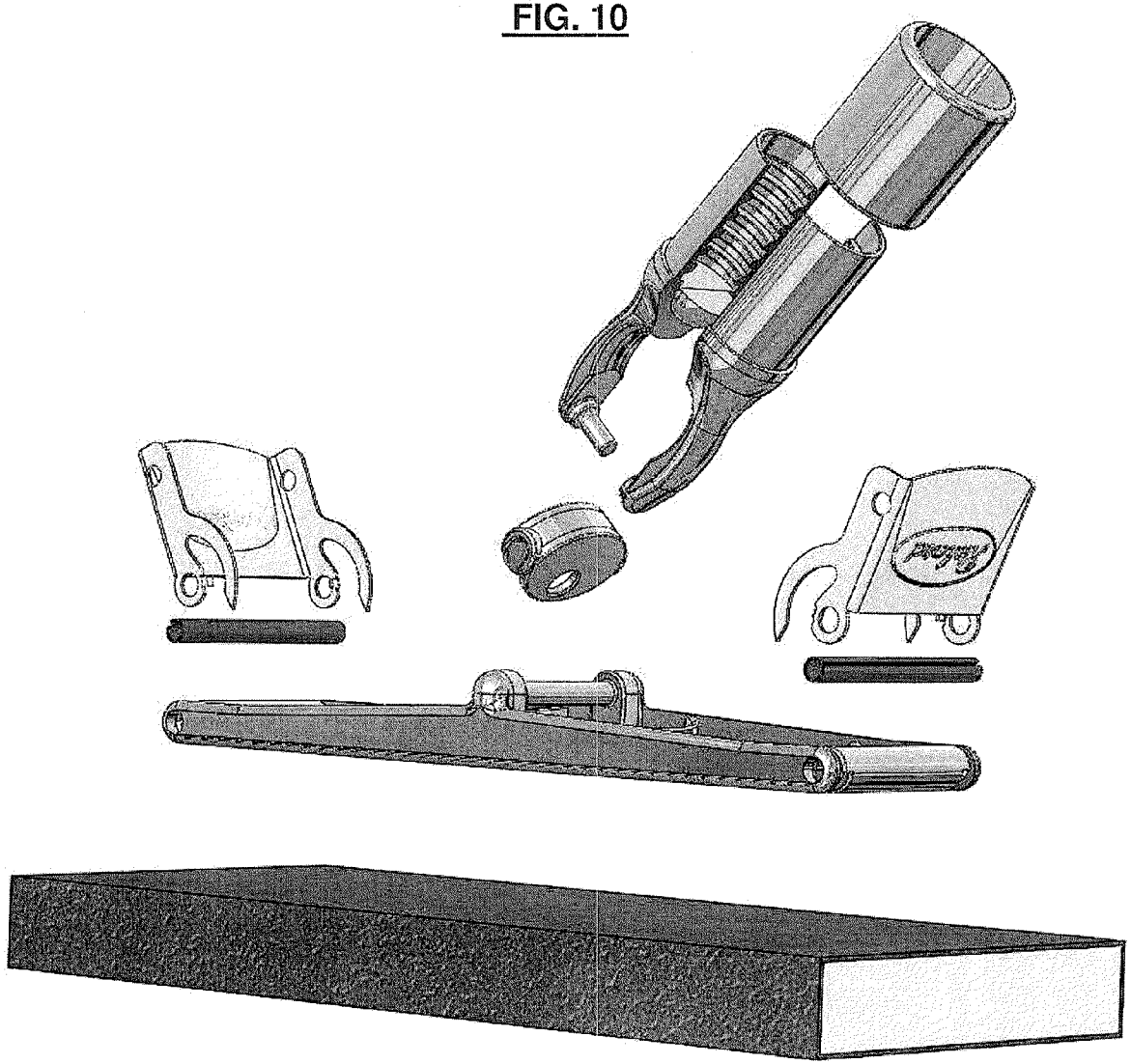
FIG. 10 is another perspective view of what is shown in FIG. 9.

As can be easily understood when referring to the accompanying drawings, the engaging mechanism (11) is preferably one that is integrated to the tool base (3), and one that is preferably retractable or rotatable, so as to be operated at least between two configurations, namely a non-operating (i.e. "first", "disengaged", "opened", "elevated", "drawn-out", etc.) configuration (so as to namely allow the abrasive sponge (9) to be removed from the working surface (7) of the base (3), as better exemplified in FIGS. 3, 9 and 10) and an operating (i.e. "second", "engaged", "closed", "inserted", "drawn-in", etc.) configuration (where, for example, each hook (13) is secured into the abrasive sponge (9) in a curvilinear manner, in a direction extending substantially away from the center (17) of the base (3), for tightening and securing the abrasive sponge (9) against the working surface (7) of the base (3) for improved fastening and performance), wherein other intermediate configurations could also be provided, as can be easily understood by a person skilled in the art.

Preferably also, the base (3) of the sanding device (1) may be provided with corresponding ribs, flanges, shoulders, and/or recesses, for appropriately sustaining the corresponding loads to which the resulting tool and corresponding components thereof may be subjected to, as apparent to a person skilled in the art.

Preferably also, the base (3) and corresponding components of the sanding device (1) according to the present invention is preferably treated metallurgically by means of a suitable treating process (ex. die-cast) so as to resist to wear and the like.

Preferably also, the base (3), lever jaws (21) and/or other portions of the present sanding device (1) are preferably selected so as to be of different colors, and different contrasting colors, so as to provide for a very attractive design of the tool, and so as to enable to commercialize the present tool under the colors of the corresponding manufacturers and the like, for example. Furthermore, the base (3), lever jaws (21) and/or other corresponding portions of the tool may be provided with suitable continuous or discontinuous strands of numbers, letters, and/or other symbols conveying information, so as to transmit to the user corresponding information regarding the tool, its distributor, and/or its manufacturer, via a corresponding logo for example, or other suitable display of information.

Finally, and according to the present invention, the tool and corresponding parts are preferably made of substantially rigid materials, such as metallic materials (stainless steel, aluminum, zinc, and/or others, as well as combinations thereof), hardened polymers, composite materials, and/or the like, whereas other components thereof (e.g. a possible covering for the lever jaw (21), etc.) according to the present invention, in order to achieve the resulting advantages briefly discussed herein (ex. better grip), can be made of a polymeric material (plastic, rubber, etc.), and/or the like, depending on the particular applications for which the sanding device (1) is intended for and the different parameters in cause (load applied to the base, required sanding capability, etc.), as apparent to a person skilled in the art.

Furthermore, the present invention is a substantial improvement over the prior art in that, by virtue of its design and components, the tool is simple and easy to use, as well as is simple and easy to manufacture and/or assemble, without compromising the reliability of its functions. Hence, it may now be appreciated that the present invention represents important advantages over other tools known in the prior art, in that the sanding device (1) according to the present invention enable to carry out sanding applications with an abrasive sponge (9), in a very quick, easy and ergonomic manner, with improved performance, due namely to its lever jaws (21) with corresponding hooks (13), as briefly explained hereinabove.

Indeed, contrary to the devices of the prior art (ex. U.S. Pat. No. 7,011,573 B2 granted to McARTHUR et al.), the present sander (1) enables the abrasive sponge (9) to be affixed onto the base (3) of the tool in a much quicker manner (two lever jaws (21) are simply used to "snap" or "hook" the abrasive sponge (9) into place instead of having to screw in a pair of fastening members with helically-shaped penetrating portions—long and tedious process). According to the present invention, a simple and more straightforward engaging (or clip) mechanism (11) is provided instead of the strenuous and disadvantageous rotating fastening members of the prior art.

The present invention is also advantageous in that it provides for four hooks (13) or "teeth" which are disposed at the four corners of the base (3) of the sander (1) which enables the sponge (9) to be retained more uniformly than by the only two fastening members with helically-shaped penetrating portions of the aforementioned McARTHUR et al. patent which are disposed adjacent to the center of the base.

The present invention is also advantageous in that it comprises two lever jaws (21) or clamps (with corresponding curved hooks (13) or teeth) which are securely mounted onto the base (3) of the sander (1) and which are preferably not intended to be removed therefrom, contrary to other devices of the prior art where the fastening means (ex. fastening members with helically-shaped penetrating portions according to McARTHUR et al.) can be unscrewed and can be removed completely from the tool thereby resulting in associated drawbacks (possible lost of the fastening members, etc.).

The present invention is also advantageous in that the two lever jaws (21) or clamps are configured to be inserted into the abrasive sponge (9) so as to first penetrate the sponge (9) and then, due to their curvilinear configuration, are meant to further increase the tightening disposition of the sponge (9) against the working surface (7) of the base via a further activation/rotation of the lever jaws (21) up until a closed (or "second") configuration where the lever jaws (21) are preferably maintained into place by the aforementioned clip mechanism (29) (optional, but not compulsory, as disposition of the hooks (13) are meant to inherently maintain the lever jaws (21) in place in the second configuration when said configuration is reached, as can be easily understood by a person skilled in the art).

Furthermore, an improvement resulting from the lever jaws (21) according to the present invention resides in the fact that their curvilinear disposition, orientation and their line of travel enable the hooks (13) of opposite lever jaws (21) to penetrate into the abrasive sponge (9) and diametrically distance themselves in order to produce a tension in the abrasive sponge (9) which stiffens the sponge (9) and enables it to be better secured against the base (3) of the sander (1), something that is not possible according to McARTHUR et al.

Another substantial advantage of the present invention resides in the fact that the swivel assembly (39) comprises less pins or rods than those of the prior art which enable for an easier and improved assembling onto the product, as well as for a more reliable performance, less cleaning, etc.

Another important advantage of the present invention resides in the provision of the least one supporting rim (63) which, as explained hereinabove, enables the rotation of the swivel assembly (39) about a range of about 360 degrees which allows for a smooth movement without interfering with surface components of the base (3) given that the at least supporting rim (63) acts as a guide for the socket component (49) (the socket component (49) will glide or slide along the at least one rim (63), as can be easily understood by a person skilled in the art).

Moreover, the present invention is also advantageous in that it provides a simpler, more easy-to-use and esthetically pleasing sanding device (1) than those of the prior art.

Of course, numerous modifications could be made to the above-described embodiments without departing from the scope of the invention, as defined in the appended claims.

The invention claimed is:

1. A sanding device for use with an abrasive sponge, the sanding device comprising:

a base having a supporting surface and an opposite working surface, the working surface being shaped and sized for receiving the abrasive sponge thereagainst;

at least one retaining mechanism mountable onto the base, and configured for removably securing a first portion of the abrasive sponge against the working surface of the base; and at least one engaging mechanism mountable onto the base, and configured for projecting out from the working surface so as to penetrate a second portion of the abrasive sponge when resting against the working surface of the base, each engaging mechanism being further configured so as to draw the second portion of the abrasive sponge away from the first portion of the abrasive sponge, each engaging mechanism being operable between a first configuration where the engaging mechanism is disengaged from the abrasive sponge thereby allowing the abrasive sponge to be removed from the working surface of the base, and a second configuration where the engaging mechanism is penetrated into the second portion of the abrasive sponge and has drawn said second portion away from the first portion so as to securely maintain the abrasive sponge against the working surface of the base, wherein each engaging mechanism comprises at least one hook being operable by a user of the sanding device between the first and second configurations, each hook being positioned, shaped and sized for selectively engaging with the abrasive sponge within said abrasive sponge, and wherein each hook is substantially arch-shaped, and wherein each hook is configured to be engageable into the abrasive sponge in a direction extending substantially away from the center of the base for tightening the abrasive sponge against the working surface of the base when the sanding device is operated in the second configuration.

2. A sanding device according to claim 1, wherein each hook is insertable into the abrasive sponge through a corresponding through-hole provided along the base.

3. A sanding device according to claim 2, wherein the base is substantially rectangular, and a corresponding through-hole is provided substantially about each corner of the base.

4. A sanding device according to claim 1, each engaging mechanism is rotatably mountable onto the base about a corresponding pivot axis, and comprises a lever jaw, such that operation of each given engaging mechanism between the first and second configurations is done by rotating the given engaging mechanism about its corresponding pivot axis via its given lever jaw.

5. A sanding device according to claim 1, wherein each engaging mechanism is rotatably mountable about its corresponding pivot axis by means of a least one hinge.

6. A sanding device according to claim 5, wherein each engaging mechanism comprises first and second hinges, and wherein each pivot axis is provided by a corresponding dowel pin removably mountable into a corresponding sleeve of the base, each sleeve of the sanding device being provided along a distal end of the base.

7. A sanding device according to claim 1, wherein the sanding device comprises first and second engaging mechanisms provided respectively on opposite ends of the base, each engaging mechanism comprising a pair of distal hooks, and each hook of each engaging mechanism being provided adjacent to a corresponding hinge of the engaging mechanism.

8. A sanding device according to claim 1, wherein the sanding device comprises at least one clip mechanism associated with each engaging mechanism for removably maintaining the engaging mechanism in the second configuration.

9. A sanding device according to claim 8, wherein each clip mechanism comprises an insert and a complementary slot, the insert being provided about a component of the base and being removably insertable into the complementary slot being provided about a portion of the engaging mechanism.

10. A sanding device according to claim 8, wherein each clip mechanism comprises a pair of distal slots each being cooperable with a corresponding insert provided about an adjacent flange of the base.

11. A sanding device according to claim 1, wherein the supporting surface of the base is provided with a swivel assembly movable with respect to the base and comprising a connector for removably receiving a complementary tool.

12. A sanding device according to claim 11, wherein the swivel assembly comprises a support rod extending between first and second supports of the supporting surface of the base, a swivel component rotatably mountable about the support rod so as to be rotatable thereabout, and a socket component rotatably mountable about the swivel component so as to be rotatable thereabout.

13. A sanding device according to claim 12, wherein the swivel component comprises a mounting recess being configured for securably mounting onto the support rod so as to be rotatable thereabout.

14. A sanding device according to claim 12, wherein the swivel component is substantially oval-shaped.

15. A sanding device according to claim 12, wherein the socket component comprises first and second components being connectable against each other so as to define a socket for removably receiving therein an extremity of a complementary tool.

16. A sanding device according to claim 15, wherein the socket is threaded for receiving a complementary threaded extremity of a complementary tool.

17. A sanding device according to claim 15, wherein each component of the socket component is provided with an extension arm, an end of the extension arm of the first socket component comprising a male part being insertable into a corresponding orifice of the swivel component for allowing the socket component to be rotated about the swivel component via said male part rotatable within said orifice.

18. A sanding device according to claim 17, wherein an end of the extension arm of the second socket component is provided with a female part for receiving the male part of the end of the extension arm of the first socket component when inserted into the orifice of the swivel component.

19. A sanding device according to claim 15, wherein the first and second components (of the socket component are securable against one another by means of a collar slidably insertable about said first and second socket components.

20. A sanding device according to claim 12, wherein the supporting surface of the base comprises at least one arched supporting rim provided adjacent to the support rod, and being configured for supporting the socket component when the socket component is being rotated about the swivel component at a near angle with respect to the base so that the socket component may slide against the least one arched supporting rim and thus prevent interference of the socket component with other surface components of the base.

21. A sanding device according to claim 20, wherein the at least one arched supporting rim comprises first and second arched supporting rims, each being provided on either side of the support rod, and being positioned, shaped and sized for allowing the socket component to be rotated with respect to the center of the base through a range of about 360 degrees without substantially interfering with other surface components of the base.

22. A sanding device according to claim 1, wherein the at least one retaining mechanism is an engaging mechanism.

23. A sanding device according to claim 1, wherein the sanding device comprises a pair of engaging mechanisms.

* * * * *